US007921940B2

(12) United States Patent
Anderson et al.

(10) Patent No.: US 7,921,940 B2
(45) Date of Patent: Apr. 12, 2011

(54) CASING HAMMER POWER SWING-OUT APPARATUS FOR DRILLING RIG

(76) Inventors: Vaughn Anderson, Courtenay (CA); Ken Anderson, Courtenay (CA)

( * ) Notice: Subject to any disclaimer, the term of this patent is extended or adjusted under 35 U.S.C. 154(b) by 100 days.

(21) Appl. No.: 12/428,512

(22) Filed: Apr. 23, 2009

(65) Prior Publication Data

US 2010/0270084 A1 Oct. 28, 2010

(51) Int. Cl.
*B25B 9/00* (2006.01)

(52) U.S. Cl. ..... 175/135; 175/161; 173/89

(58) Field of Classification Search ..... 175/135, 175/161; 173/89

See application file for complete search history.

(56) References Cited

U.S. PATENT DOCUMENTS 2,217,674 A * 10/1940 Curtis ..... 173/187
4,405,020 A * 9/1983 Rassieur ..... 173/89
2003/0024713 A1 * 2/2003 Han et al. ..... 173/89

* cited by examiner

*Primary Examiner* — William P Neuder
(74) *Attorney, Agent, or Firm* — Barnes & Thornburg LLP

(57) ABSTRACT

A swing-out apparatus for a drill rig, typically for drilling water wells. It includes a sled which is formed to be driven vertically on a drill mast of a vehicle carrying the sled, a casing hammer, and a hinge securing the casing hammer on the sled. To provide for displacement of the casing hammer relative to the sled, a drive is provided for swinging the casing hammer on the hinge from a deployed position to an inactive position. The drive comprises a motor connected for driving one relative to another.

8 Claims, 5 Drawing Sheets

CASING HAMMER POWER SWING-OUT APPARATUS FOR DRILLING RIG

BACKGROUND OF THE INVENTION

This invention relates to drilling rigs, and in particular to a swing-out apparatus which includes a casing hammer that can be displaced from an active, deployed position to an inactive position.

Under normal drilling conditions for water wells, when the drilled hole is completed, the drill rod must be removed. This is typically accomplished with either a top head drive or a main winch extending from the mast of the drill rig. Typically, the main winch is much faster for withdrawing the drill rod. To use the winch, what is known as the casing hammer, which is typically deployed at a position above the well casing, is moved out of the way. In the past, this has been done by removing guides that physically attach the hammer to the mast, and then the hammer is placed aside. Another way has been to use a sled on the drilling mast, and attach the casing hammer to the sled on a pair of hinges. The hammer can then be swung out of the way while still attached to the sled and the drill rig so that other work can be performed.

While swinging the hammer out of the way, while maintaining it on the drill rig, is advantageous, in the past, that has been done by hand. This is very difficult, as the casing hammer is quite heavy, and therefore difficult to either move into place above the well casing for the drilling process, or move aside so that the casing and well head is clear for easy access.

SUMMARY OF THE INVENTION

The invention is a swing-out apparatus for a drill rig, which includes a sled which is formed to be driven vertically on a drill mast. A casing hammer is pivotally secured to the sled, and a drive is included for swinging the casing hammer from a deployed position to an inactive position.

In accordance with the preferred form of the invention, a hinge is used to secure the casing hammer to the sled, although any other means of allowing swinging of the casing hammer relative to the sled can be used. The hinge comprises a first pivot member secured to the sled and a second pivot member secured to the casing hammer. The pivot members are connected at a joint axis, and the drive comprises a motor mounted on the second pivot member and drivingly connected to a sprocket at the joint axis. The drive includes a chain which extends about and between the sprocket and a drive sprocket driven by the motor. In the preferred form of the invention, the motor is a hydraulic motor.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
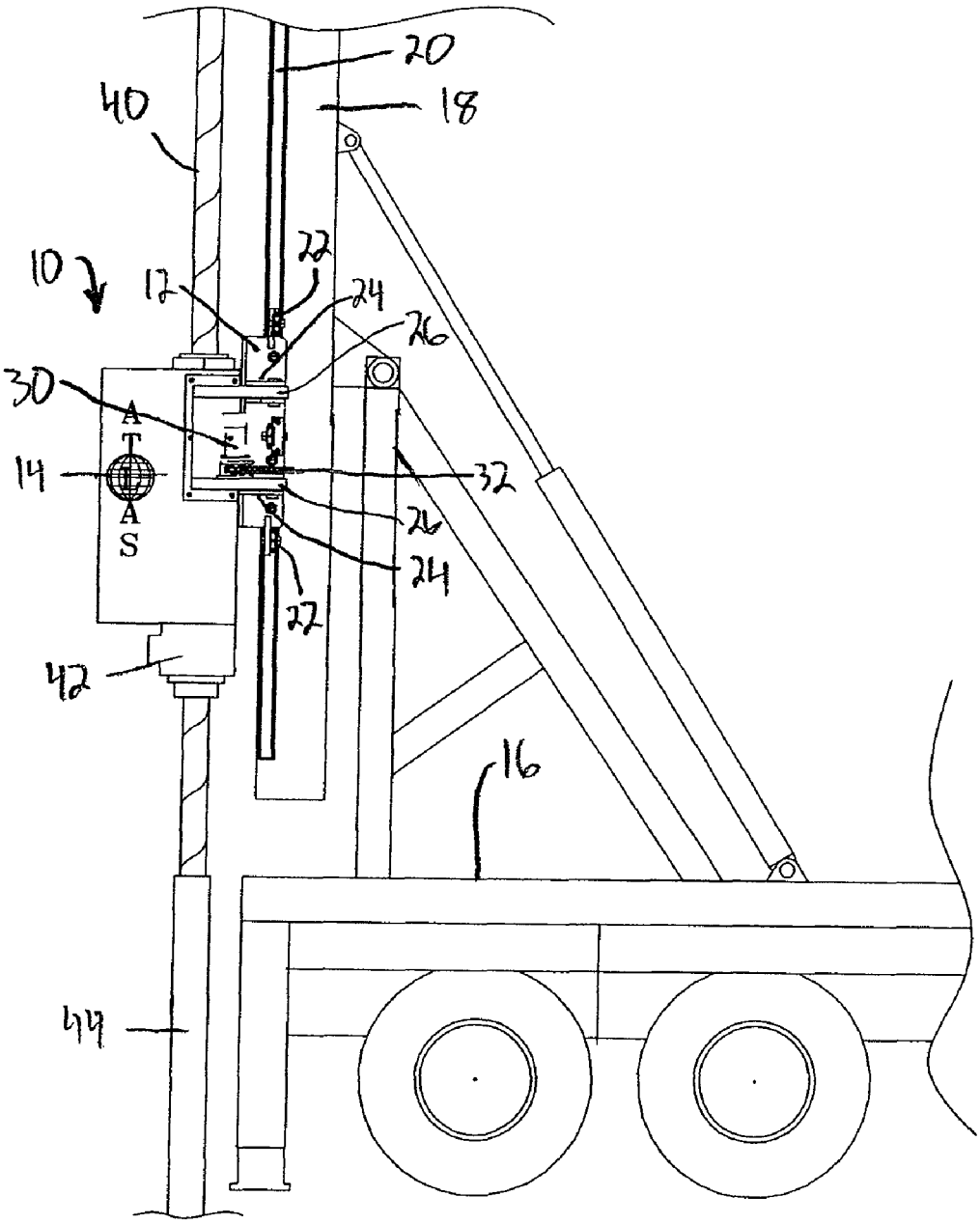
FIG. 1 is an elevational illustration of the invention as mounted on a drill rig, when in the deployed or active position.

A swing-out apparatus for a drill rig according to the invention is shown generally at 10 in the drawing figures. The swing-out apparatus comprises two basic components, a sled 12 and a casing hammer 14.

The swing-out apparatus 10 is typically mounted on a portable drill rig 16. The drill rig 16 is conventional, and is therefore not described in full detail. It does include, however, a mast or derrick 18 which, when the drill rig 16 is used for drilling a well, is deployed in a vertical orientation as shown in the drawing figures. The mast 18 include opposite rails 20, as illustrated.

Figure 5:
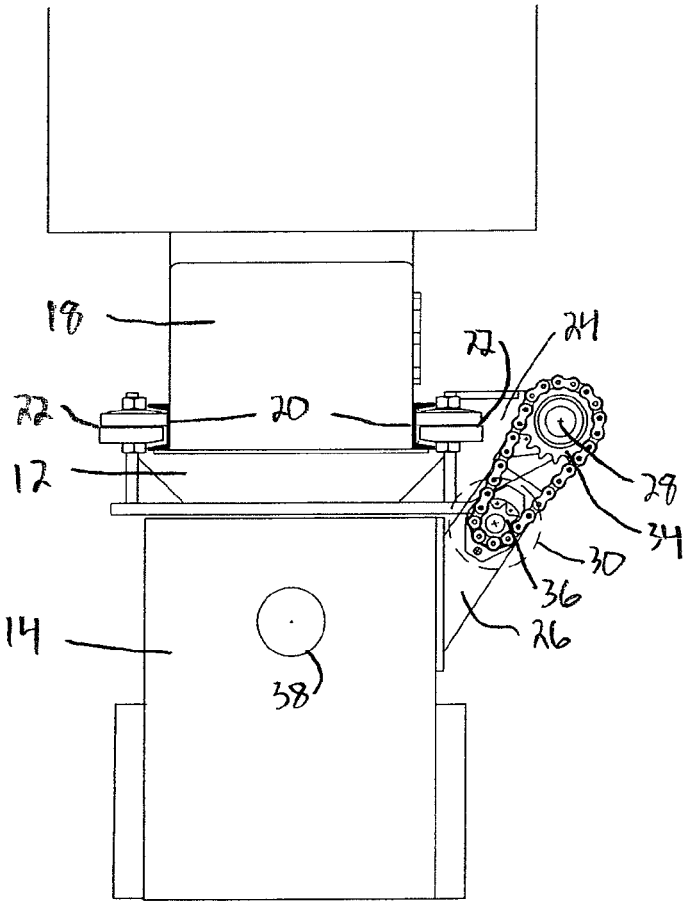
FIG. 5 is an enlarged top plan view of the invention with the casing hammer in the deployed or active position.
Figure 6:
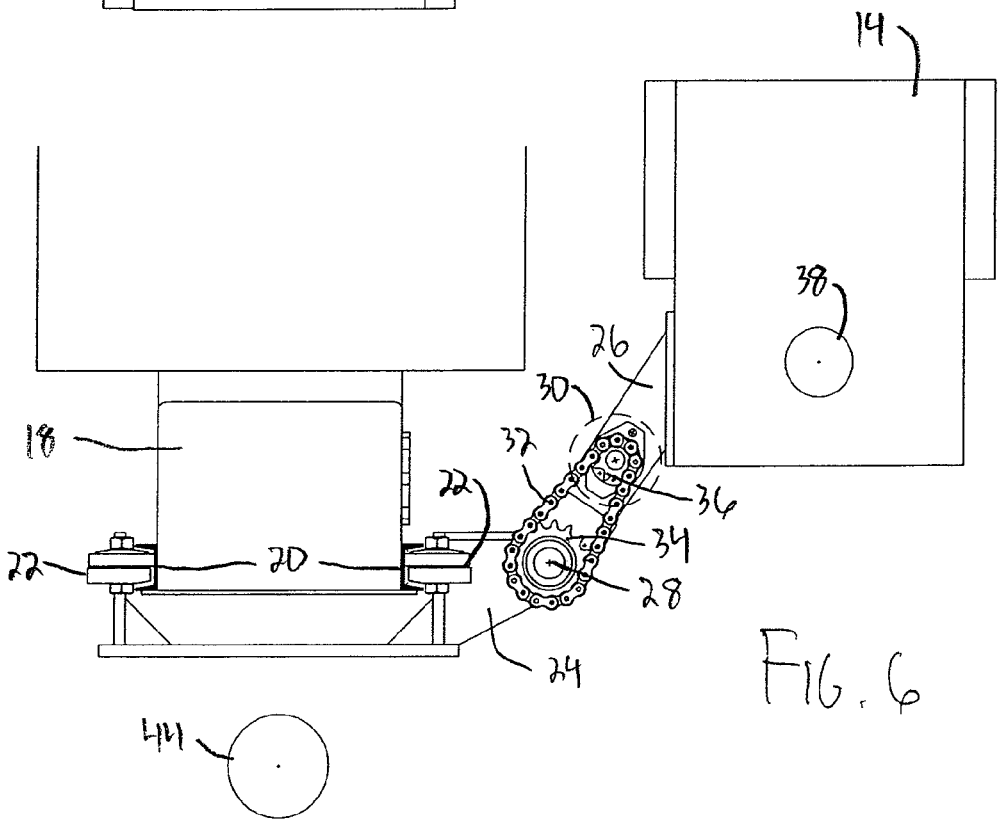
FIG. 6 is a view similar to FIG. 5, but with the casing hammer in the inactive position.

The sled 12 is mounted on the rails 20 by means of rollers 22. As best shown in FIGS. 5 and 6, the rollers 22 engage the rails 20, thus allowing the sled 12 and casing hammer 14 to travel from the top to the bottom of the mast 18.

The casing hammer 14 is hingely secured to the sled 12 by a hinge which includes top and bottom first pivot members 24 secured to the sled 12, and second top and bottom pivot members 26 secured to the casing hammer 14. The pivot members 24 and 26 are connected at a joint axis 28.

Figure 2:
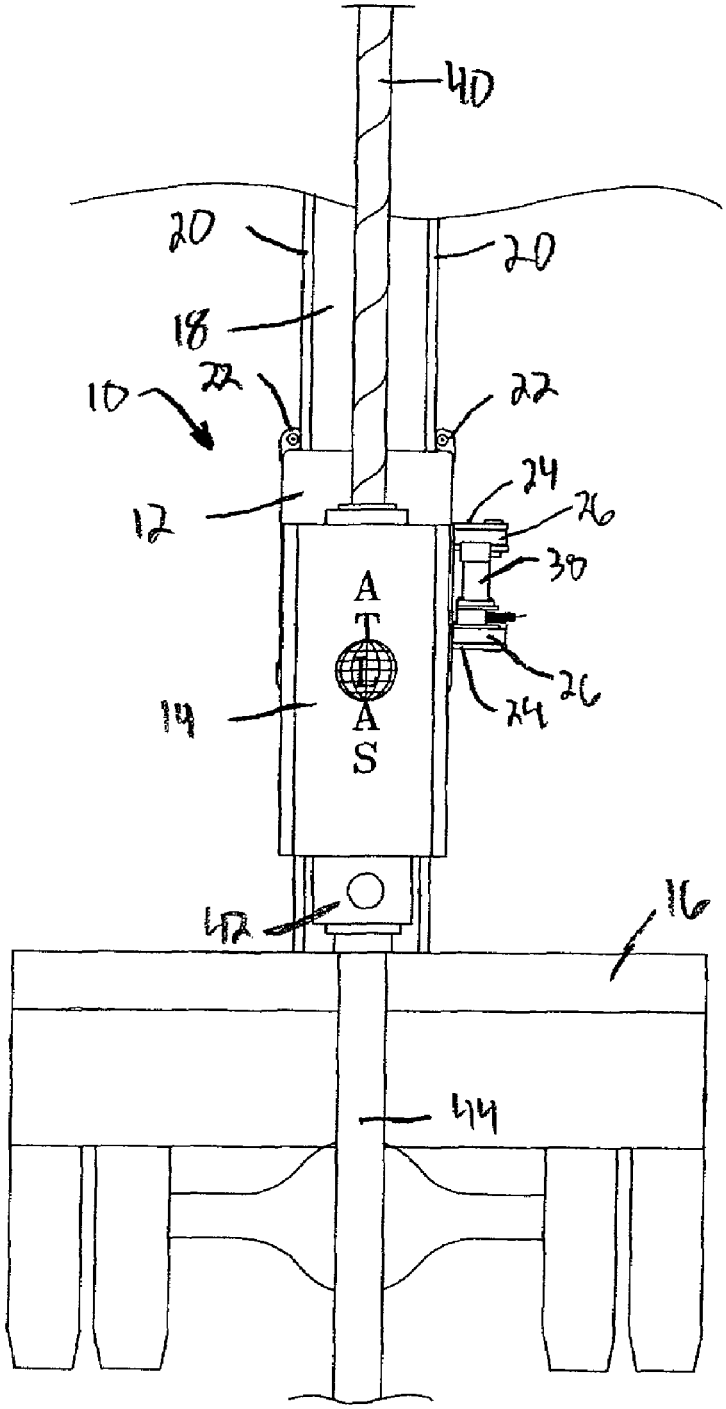
FIG. 2 is a rear elevational view similar to FIG. 1, but with the casing hammer engaged with the well casing.
Figure 3:
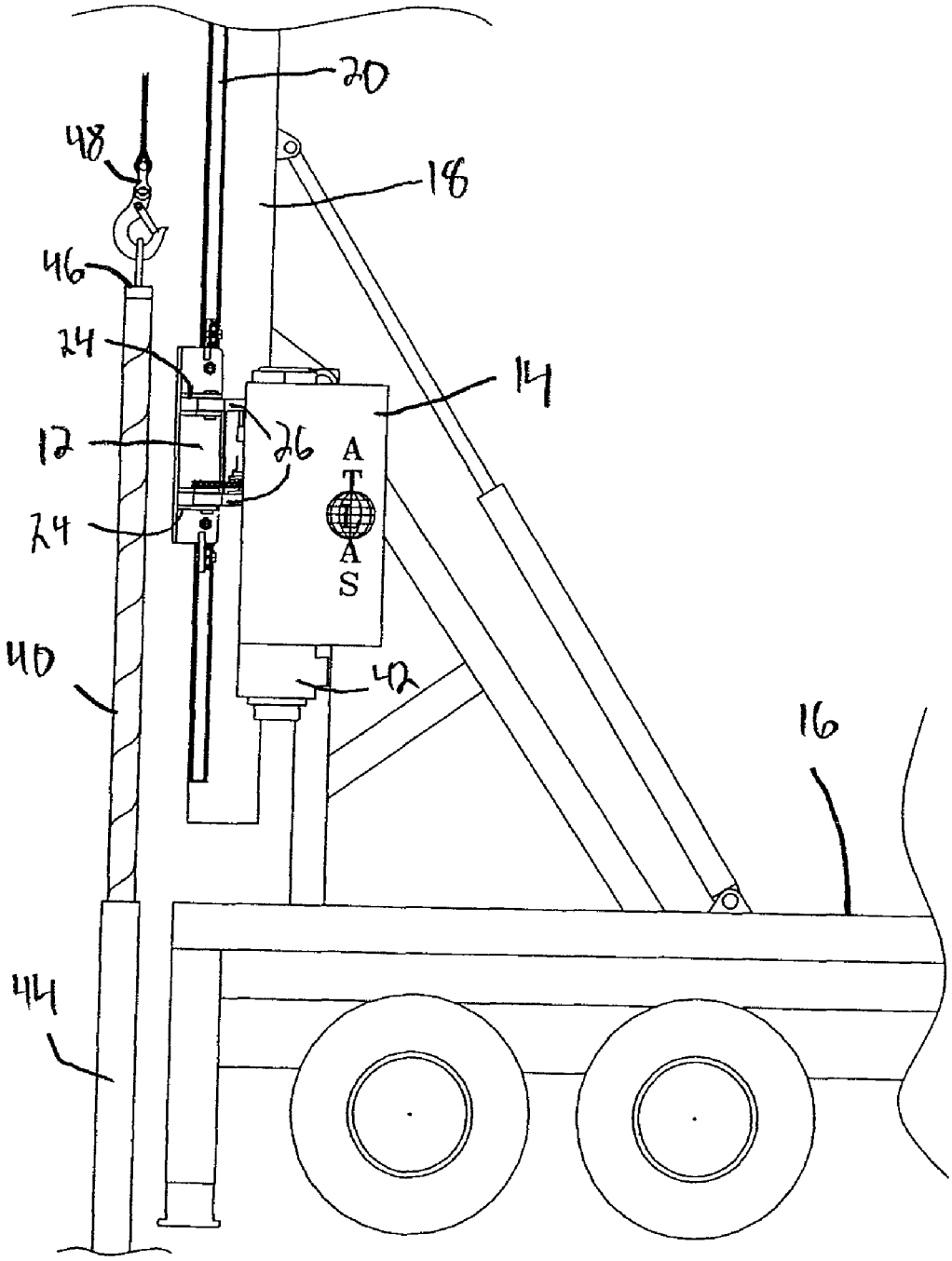
FIG. 3 is a view similar to FIG. 1, but with the casing hammer in the inactive position.
Figure 4:
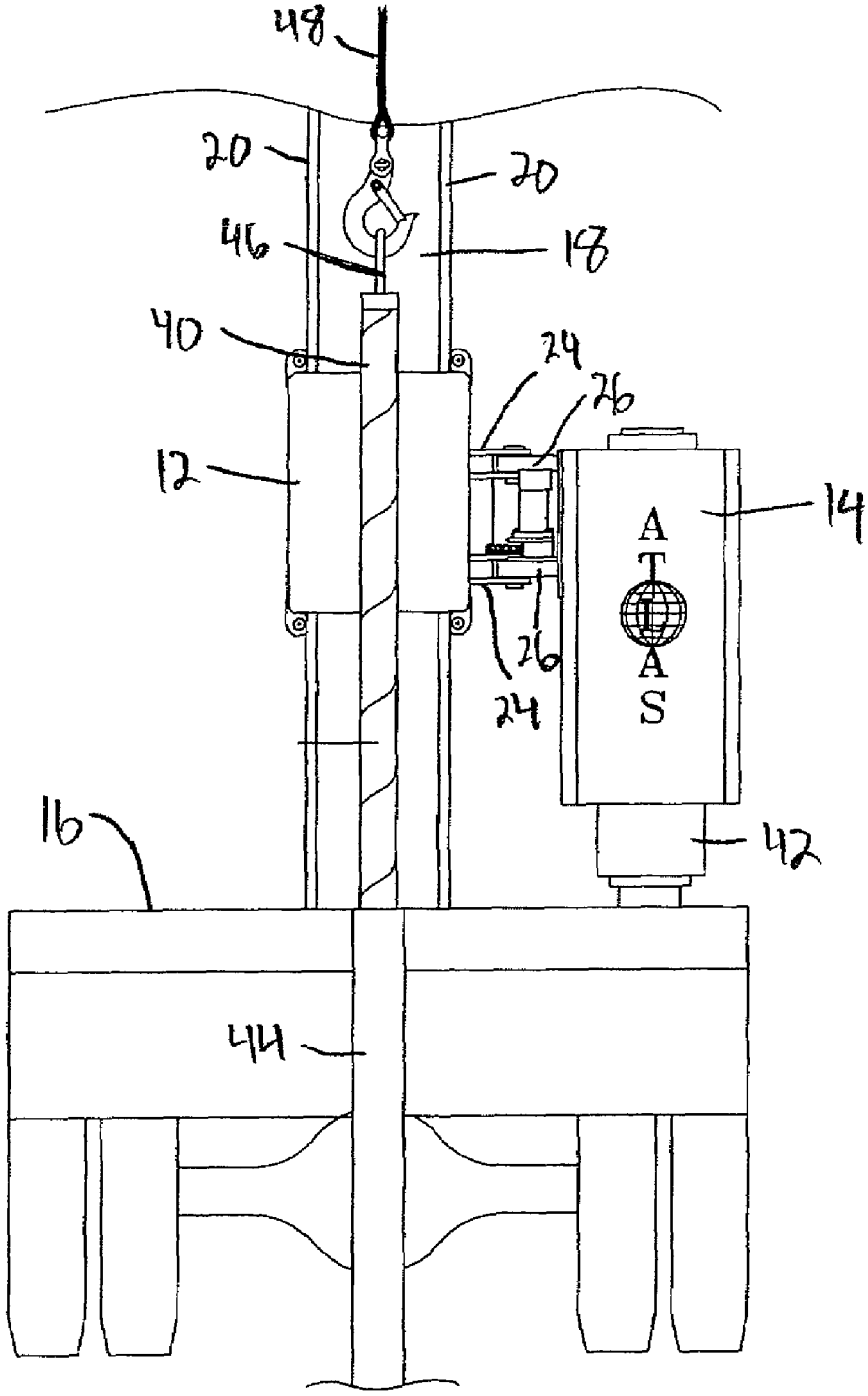
FIG. 4 is a view similar to FIG. 2, but with the casing hammer in the inactive position.

A drive is provided for moving the casing hammer 14 from the deployed position of FIGS. 1, 3 and 5 to the inactive position shown in FIGS. 2, 4 and 6. The drive comprises a motor 30 mounted on the pivot members 26 and drivingly connected by a chain 32 to a sprocket 34. The sprocket 34 is affixed to the first pivot member 24 concentric with the joint axis 28. The chain 32 is driven by a drive sprocket 36. The motor 30 and its associated components for swinging the casing hammer 14 from the deployed or active position to the inactive position are best shown in FIGS. 5 and 6.

It is preferred that the motor 30 is a hydraulic motor, thus capable of employing available hydraulics typically used by the portable drill rig 16. Obviously, other types of motors can also be employed as the motor 30.

The casing hammer 14 may be conventional, and includes a thru hole 38 through which, when in the deployed position shown in FIGS. 1, 3 and 5, a drill rod 40 extends for drilling a well in a conventional fashion, not part of the invention. The casing hammer 14 also includes an anvil 42 which is used to drive well casing 44 in a conventional fashion as a well is drilled.

Drilled wells can be many, many meters in depth, and when the drill rod 40 must be extracted, either during the drilling process or thereafter, the drill rod 40 must be extracted from the well casing 44. As explained above, the fastest way to remove the drill rod 40 is by means of the main winch of the drill rig 16. To this end, once the casing hammer is swung to the inactive position shown in FIGS. 2, 4 and 6, a lifting bail 46 is secured to the top of the drill rod 40. The main winch of the drill rig 16, only a portion of which is shown at 48, then is engaged on the lifting bail 46 to withdraw the drill rod 40 from the casing 44 in a conventional fashion.

Various changes can be made to the invention without departing from the spirit thereof or scope of the following claims.

What is claimed is:

1. In a swing-out apparatus for a drill rig, the swing-out apparatus including a. a sled formed to be driven vertically on a drill mast, b. a casing hammer carried by said sled, and c. a hinge securing said casing hammer on said sled, the improvement comprising d. a drive for swinging said casing hammer on said hinge from a deployed position to an inactive position, and e. said hinge comprising a first pivot member secured to said sled and a second pivot member connected to said casing hammer, said pivot members being connected at a joint axis, and said drive comprises a motor mounted on said second pivot member and drivingly connected to a sprocket at said joint axis.

2. The swing-out apparatus according to claim 1, in which said drive includes a chain extending about and between said sprocket and a drive sprocket driven by said motor.

3. The swing-out apparatus according to claim 1, in which said motor is a hydraulic motor.

4. The swing-out apparatus according to claim 1, in which said hinge includes a pair of each of said first and second pivot members.

5. A swing-out apparatus for a drill rig, comprising a. a sled formed to be driven vertically on a drill mast, b. a casing hammer pivotally secured to said sled, and c. a drive for swinging said casing hammer from a deployed position to an inactive position, and d a hinge securing said casing hammer on said sled, said hinge comprising a first pivot member secured to said sled and a second pivot member connected to said casing hammer, said pivot members being connected at a joint axis, and said drive comprises a motor mounted on said second pivot member and drivingly connected to a sprocket at said joint axis.

6. The swing-out apparatus according to claim 5, in which said drive includes a chain extending about and between said sprocket and a drive sprocket driven by said motor.

7. The swing-out apparatus according to claim 5, in which said motor is a hydraulic motor.

8. The swing-out apparatus according to claim 5, in which said hinge includes a pair of each of said first and second pivot members.

* * * * *